US007422104B2

(12) United States Patent
Perkinson

(10) Patent No.: US 7,422,104 B2
(45) Date of Patent: Sep. 9, 2008

(54) MULTI-PACK PACKAGING AND DISPENSER

(75) Inventor: Randolph Wills Perkinson, Marietta, GA (US)

(73) Assignee: LAVA Group Packaging, LLC, Atlanta, GA (US)

( * ) Notice: Subject to any disclaimer, the term of this patent is extended or adjusted under 35 U.S.C. 154(b) by 513 days.

(21) Appl. No.: 11/063,062

(22) Filed: Feb. 22, 2005

(65) Prior Publication Data

US 2006/0186009 A1 Aug. 24, 2006

(51) Int. Cl.
*B65D 75/00* (2006.01)

(52) U.S. Cl. ..... 206/427; 229/117.13; 229/242

(58) Field of Classification Search ..... 206/141, 206/170, 175, 430, 427; 229/103.2, 117.13, 229/240, 241, 242

See application file for complete search history.

(56) References Cited

U.S. PATENT DOCUMENTS 1,983,418 A * 12/1934 Thurmer ..... 206/427
3,167,214 A * 1/1965 Mahon ..... 206/155
4,470,503 A * 9/1984 Stone ..... 206/141
4,478,334 A * 10/1984 Graser ..... 206/427
6,065,590 A * 5/2000 Spivey ..... 229/117.13
6,631,803 B2 * 10/2003 Rhodes et al. ..... 206/427
6,766,940 B2 * 7/2004 Negelen ..... 229/117.13
6,902,104 B2 * 6/2005 Holley et al. ..... 206/427

* cited by examiner

*Primary Examiner*—Luan K Bui
(74) *Attorney, Agent, or Firm*—Smith Frohwein Tempel Greenlee Blaha, LLC; Gregory Scott Smith

(57) ABSTRACT

A multi-pack packaging and dispenser that is suitable for carrying and dispensing glass bottles, such as beer bottles, as well as a variety of other objects. The packaging includes a main access panel that is generally located on the top of the package but, could also be located on the sides or bottom. The main access panel includes a weakened portion that extends the entire width of the panel and less the half of the depth of the panel. When the weakened portion is removed and the main access panel is turned to face a point of access, the contents can be removed through the opening in the access panel created by removing the weakened portion. By orienting the opening to be in the lower portion of the access panel and orienting the access panel to be perpendicular to the surface on which the package rests, as objects are removed from the package, other objects fall into the opening for dispensing.

4 Claims, 6 Drawing Sheets

MULTI-PACK PACKAGING AND DISPENSER

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISK APPENDIX

Not applicable.

BACKGROUND OF THE INVENTION

The invention relates to the field of packaging and, more particularly to a foldable package that is suitable for carrying and dispensing objects.

Every marketer learns in their Marketing 101 class that packaging sells products. Two aspects of packaging include attraction and convenience. Much care and attention is put into the aesthetics of packaging in an effort to capture the eye or the attention of a consumer. Anything that can be used to gain even a moment of hesitation as a consumer is scanning the shelves of a store greatly increases the probability that the consumer will select that product. Another aspect of packaging is the convenience factor. If the packaging helps to improve the life of the consumer, then the packaging has a higher probability of selling the product to the consumer.

An example of a resent packaging breakthrough can be seen in the canned beverage market with the introduction of the fridgepack. The fridgepack, most commonly seen used in the packaging of soft drinks but also used for canned beer, conveniently provides a package that is suitable for carrying a quantity of canned drinks and, also servers as a dispensing mechanism that can be placed into a refrigerator or on a consumer's pantry shelf. Examples of such a package can be seen in U.S. Pat. Nos. 6,283,293 issued to Lingamfelter and 6,578,736 issued to Spivey.

In general, the fridgepack includes a built in handle that allows a consumer to easily carry the contents, usually 12 canned beverages, and includes a perforated opening on one end. Once the perforated opening is removed, the canned beverages can be easily dispensed from the packaging. Thus, the consumer is relieved of the cumbersome process of opening the packaging, stacking the canned beverages on the shelf of the refrigerator, and reaching to the back of the refrigerator to retrieve the last few cans. However, an inherent problem with the fridgepack is that when the consumer removes all but the last row of product, the amount of the product that still resides within the container is not readily known to the consumer due to the design of the fridgepack.

An industry that has not shared the benefit of the convenience of a fridgepack like packaging is the bottled drink industry. There are several design problems that have limited the use of such a convenient packaging mechanism in the bottled drink industry. One such problem is the fact that bottled beverages are substantially heavier than canned beverages. In addition, the ramifications realized by the failure of bottled drink packaging are significantly more severe than that for canned beverages. For instance, bottled drinks are not as resilient to being dropped as can beverages are. On top of this, the broken glass resulting from a failure of bottle drink packaging creates a potential injury hazard that would increase the liability of the packaging company and the product distributor. Because of these reasons, the handle portion of a package used to carry bottled beverages must be rugged to prevent breakage or tearing. In addition, the entire package must support the weight of the bottled beverages that are stored within it.

The introduction of a perforated opening, typically located on the side or end panels similar to the opening used in the fridgepack design for canned beverages, creates a structural weakness in the packaging. Utilizing such a structure for a bottled beverage package imposes a risk. For instance, if the perforation fails while a consumer is carrying the packaged product, the handle may also fail or, bottles may escape the packaging thereby causing the package to be dropped or the contents to be spilled. Thus, packaging for bottled beverages should take such structural issues into consideration.

Another issue that is faced by glass bottled beverage packagers is the need for dividers to be placed within the package as a cushion between the bottles. The absence of such dividers can result in impact between the glass bottles causing breakage. Such dividers can also add to the complexity of creating a package that is also conducive for dispensing the glass bottled beverages in that the dividers can inhibit the consumer's ability to extract the bottles from the packaging.

Another problem hindering the development of fridgepack like packaging features for bottled beverages is the bottle packaging itself. Generally, bottled beverages should be shelved in the warehouse and store shelves in an upright manner. This is due to the fact that the structure of the bottles provides significantly more strength when they are upright. Thus, if multiple packages are stacked on top of each other, the structure provided by the upright bottles decreases the probability of breakage. In contrast, if the bottles are packed on their side, the probability of breakage is significantly increased.

Several designs for packaging bottled beverages have been introduced to the market; however, the available designs are not sufficient for use as a fridgepack like package. The deficiencies in the available packaging include the fact that a dispensing mechanism is not included that allows the package to be easily stored in a refrigerator and yet, provides easy access for a consumer to extract all the bottles. The current state of the art packaging includes a weakened portion that can be extracted to provide the consumer access to the interior portion of the package. However, to maintain the structural integrity of the packaging, the size and location of the opening is greatly limited. Thus, once the perforated material is removed, the consumer does not have easy access to the interior.

Another issue that packaging designers are faced with is limiting the cost of packaging. Every penny that is added to the cost of the packaging must be passed on to the consumer, borne by the industry, or shared by both. Thus, any changes in the packaging of bottled beverages must carefully weigh the cost in view of the potential increase or decrease in product sales.

What is needed in the art is a packaging design that allows products to be stored in an upright manner while being warehoused or shelved at a retail location, that is structurally sound for carrying the package, and that provides a fridgepack like dispensing capability that provides ease of access to the contents. Such a packaging design would be beneficial for the packaging of bottled beverages, but would also be applicable to packaging of a variety of other bottled items as well as other items. In addition, there is a need in the art for a fridgepack like packaging for bottled drinks that minimizes any impact on the cost of the packaging process.

SUMMARY OF THE INVENTION

The present invention is best illustrated in an embodiment of a beer bottle carrier. The beer bottle carrier is formed from a flat cut-out and foldable material. One panel of the carrier includes a weakened portion that extends the entire width of the panel. The contents of the package are oriented so that one end of the object is proximal to this panel. For the beer bottle carrier, the tops of the beer bottles are proximal to this panel. Once the weakened portion is removed, the beer bottles can be accessed through the opening created. By orienting the package on a shelf, such as a refrigerator shelf, so that the opening is facing the point of access and is oriented near the shelf face, additional beer bottles fall into place as bottles are removed from the opening. When the contents of the beer bottle carrier are such that only one row of bottles remains, once a bottle is removed, a vacant space is created thus giving the customer knowledge about how many beers remain in the package.

The present invention can be incorporated into a variety of embodiments and may use one or more of the various aspects of the present invention. In addition, embodiments of the present invention can be used for storing and dispensing of a variety of objects and is not limited simply for beer bottles.

DETAILED DESCRIPTION OF THE INVENTION

The present invention is directed towards an improved product package that is suitable for both carrying various products as well as dispensing the products. More specifically, the present invention defines a package that can be cut out from one or more flat panels and then folded and held in position with an adhesive or other mechanism to create a package that includes structurally sound handle that is suitable for carrying a fully loaded package. In addition, the present invention defines a perforated or removable panel that can be removed from the assembled package to facilitate dispensing of the product within the package. Several aspects and advantages of the present invention will be more fully described with reference to the detailed figures.

Figure 1:
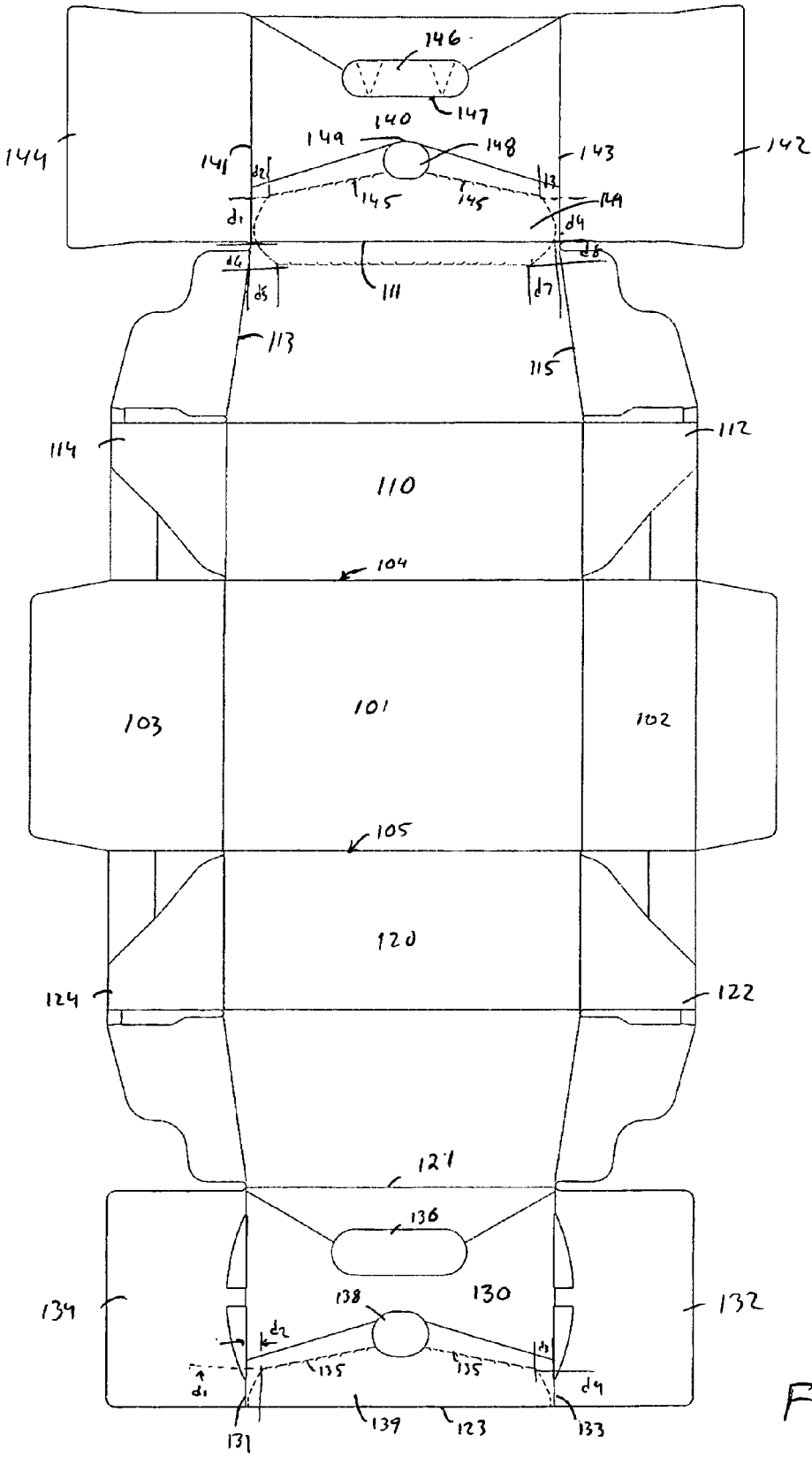
FIG. 1 is a flatly spread out plan view of a cut out structure for one embodiment of the present invention.

FIG. 1 is a flatly spread out plan view of a cut-out structure for one embodiment of the present invention. The cut-out structure includes a variety of panels and flaps along with fold lines, cut-out portions and weakened or perforated portions. As will be more fully described with reference to FIG. 2, the cut-out structure can be folded along the fold lines and held together using an adhesive material, or other mechanism, to create a package suitable for holding, carrying and dispensing product. The cut-out structure can be fabricated using a variety of materials, such as cardboard, pressed board, plastic, or other suitable materials and the present invention is not limited to any particular material utilized.

Throughout this detailed descriptions, the illustration of utilizing aspects of the present invention will be described primarily in relationship to housing and dispensing bottled beverages, such as bottled beer, however, it should be appreciated that the various aspects of the present invention are not limited to such use and the illustrative use is simply to provide a clear understanding of the various aspects of the present invention. The various aspects of the present invention can be incorporated into housing and dispensing packages for a variety of products including, but not limited to, canned goods, candles, plumbing fixtures, batteries, bricks, candy bars or any of a variety of other products. Those skilled in the art will be able to adapt the various aspects of the present invention into a variety of embodiments suitable for the purposes for which the packaging is being utilized.

Flat Panel Cut-Out

The embodiment illustrated in FIG. 1 shows a cut-out structure that includes five main panels. It should be appreciated that although the cut-out structure is shown as a single piece of material, the structure could also comprise multiple pieces of material that are joined together to create a similar structure and the various aspects of the present invention are not applicable only to a single-piece structure. A first panel 101 includes a first flap 102 and a second flap 103. The first panel 101 is shown as being substantially rectangular in shape; however, the panel may also be substantially square, can include a slight taper, can be slightly trapezoidal or assume a similar parallelogram shape. For the exemplary embodiment of carrying and dispensing bottled beer, the first panel 101 is preferably rectangular and of dimensions suitable for housing 12 bottles arranged in three rows of four bottles with the bottoms of the bottles resting on the first panel 101. However, even for the exemplary embodiment, the shape can vary. For instance, the shape of the first panel 101 could be substantially square to accommodate 16 bottles arranged in four rows of four bottles each or 9 bottles arranged in three rows of three bottles. Likewise, various other configurations having any number of row and column configurations could also be supported in other embodiments.

The first panel 101 is adjoined to a second panel 110 along an edge 104. The second panel 110 is shown as being substantially rectangular with a portion of the panel slightly tapering inwardly at the end opposed to the edge 104. Alternatively, the second panel 110 may be completely rectangular without departing from the scope and the spirit of the present invention. The second panel includes a third flap 112 and a fourth flap 114. The dimensions of the second panel 110 is substantially the same dimension as the first panel along the adjoining seam 104 and of sufficient size in the direction perpendicular to the adjoining seam 104 to extend the length of the products to be housed within the package.

The first panel 101 is also adjoined to a third panel 120 along an edge 105. The third panel 120 is shown as being a mirrored image of the second panel 110; however, this is simply one embodiment of the present invention and the mirrored relationship between the second panel 110 and the third panel 120 is not a required feature of the present invention, although the particular structure can be considered one novel aspect of the present invention. The third panel 120 includes a fifth flap 122 and a sixth flap 124 and is similarly dimensioned as the second panel 110.

The third panel 120 is adjoined with a fourth panel 140 along an edge or seam 121. The edge 121 is substantially parallel with the edge 105 adjoining the first panel 101 and the third panel 120. The fourth panel 130 is substantially rectangular in shape and includes a seventh flap 132 and an eight flap 134. However, similar to the first panel 101, the fourth panel does not have to be rectangular. The dimensions of the fourth panel 130 can be substantially identical to the dimensions of the first panel 101 or may be slightly scaled to be larger or smaller depending on the shape of the objects to be stored within the package. For the exemplary embodiment, because beer bottles are generally tapered, the fourth panel 130 is slightly smaller than the first panel 101. Such a structure coincides with a tapering of the panel shape for the second panel 110. However, it will be appreciated that aspects of the present invention are also applicable when storing non-tapered products or products of different shapes and thus, the decrease in the size of the fourth panel 130, although in and of itself may be an inventive component of the present invention, is not considered a limitation of the present invention.

The fourth panel is also illustrated as including an oblong shaped cut-out 136 positioned proximate to the edge 121 and an oval or substantially circular shaped cut-out 138 positioned distal to the edge 121. As will be shown more clearly, the purpose of these cut-outs is to facilitate a handle portion in which the fingers can be inserted into the oblong shaped cut-out 136 and the thumb into the oval or substantially circular shaped cut-out 138. It should be appreciated that the exact shapes of these cut-outs can vary and the exact structure is not a limiting aspect of the present invention, although in and of themselves, may be considered a novel aspect. For instance, the cut-outs could be rectangular shaped, triangular or square. In addition, the oblong shaped cut-out 136 could be replaced with two or more separate cut-outs in other embodiments (i.e., for a bowling ball style grip).

A first weakened portion 139 is defined within the fourth panel by a perforated line or a line of weakening 135. The weakened portion 139 extends substantially from edge 131 of the fourth panel 130 to edge 133 of the fourth panel. In some embodiments, the weakened portion 139 may extend all the way to the edges 131 and 133 and in other embodiments, the weakened portion may even extend beyond the edges 131 and/or 133 and onto the seventh flap 132 and/or the eight flap 134. In the illustrated embodiment, the line of weakening 135 that defines the weakened portion 139 that extends through the substantially circular shaped cut-out 138; however, in other embodiments the line of weakening 135 may simply pass in close proximity to the cut-out 138, either on the side proximate to the edge 121 or the side distal to the edge 121.

In the illustrated embodiment, the line of weakening 135 begins near a corner defined by edge 131 and edge 123. The line of weakening 135 extends towards edge 121 and edge 133 with a slight taper or arc away from edge 131 and edge 123 for a distance d1 from the edge 123 and d2 from the edge 131. From this point, the line of weakening 135 then extends away from the edge 131 at an angle in relationship to edge 121 that can range from negative 10 degrees (angled towards edge 123) to zero degrees (parallel to edge 121) to approximately a 40 degree angle towards edge 121. At a point approximately equidistance between the edge 131 and the edge 133, the line of weakening 135 then angles towards the edge 133 at an angle in relationship to edge 121 that can range from negative 10 degrees (angled towards edge 121) to zero degrees (parallel to edge 121) to approximately a 40 degree angle away from the edge 121. At a point that is a distance d3 from the edge 133 and a distance of d4 from the edge 123, the line of weakening 135 then tapers or arcs substantially in the direction of a corner defined by the edge 133 and the edge 123.

In the illustrated embodiment, the distances d2 and d3 are approximately between 0.25 of an inch to 0.75 of an inch and the distances d1 and d4 are approximately between 0.5 of an inch and 1.5 of an inch. However, it should be appreciated that the specificity describe with relationship to the line of weakening 135 is simply for illustrative purposes and is not set forth as a limitation of the present invention; although the specific measurement and/or shape may in themselves constitute novel aspects of the present invention. In fact, those skilled in the art will appreciate that the line of weakening may be comprised of an arc that extends from approximately the corner defined by edge 131 and edge 123 to the corner defined by edge 133 and edge 123. Alternatively, the line of weakening 135 may extend parallel or coincidental to edge 131 for a first distance, then extend from edge 131 to edge 133 along a line that is parallel to edge 123, and then extend parallel or coincidental to edge 133 extending to edge 123. In addition, a large variety of other characteristics, shapes and patterns can be imposed on the line of weakening 135 without departing from the spirit and scope of the present invention.

The second panel 110 is adjoined with a fifth panel 140 along an edge or fold line 111. The edge 111 is substantially parallel with the edge 104 adjoining the first panel 101 and the second panel 110. The fifth panel 140 is substantially identical in shape and size to the fourth panel 130 and includes a ninth flap 142 and a tenth flap 144. The fifth panel 140 includes a partial cut-out 146 that is oblong in shape and is substantially equal in size to the oblong cut-out 136 in the fourth panel 130. In the illustrated embodiment, the partial cut-out 146 is completely cut through the fifth panel 140 except for a portion along an edge 147 of the partial cut-out 146. Thus, in this embodiment the partial cut-out 146 constitutes a flap that can be folded along the edge 147. It should be appreciated that the partial cut-out 146 could also be totally cut out from the fifth panel 140 or the portion that is not completely cut through the fifth panel 140 could be along a different edge other than edge 147.

The fifth panel 140 also includes a partial cut-out 148 that is oval or substantially circular in shape and is substantially equal in size to the substantially circular cut-out 138 in the fourth panel 130. In the illustrated embodiment, the partial cut-out 148 is completely cut through the fifth panel 140 except for a portion along an edge 149 of the partial cut-out 148. Thus, in this embodiment the partial cut-out 148 constitutes a flap that can be folded along the edge 149. It should be appreciated that the partial cut-out 148 could also be totally cut out from the fifth panel 140 or the portion that is not completely cut through the fifth panel 140 could be along a different edge other than edge 149. It should be appreciated that the fifth panel 140 may or may not be necessary in various embodiments of the present invention. The need can be based on the weight of the product within the packaging and the strength of the packaging required to support the product. It should also be appreciated that the openings 136 and 138 and the partial cut-outs 146 and 148 can take on a variety of shapes and the illustrated shapes, although in and off themselves may be novel, are not a limiting factor for the present invention. Thus, the openings could be rectangular, equal in size and shape, or take on a variety of other characteristics.

A second weakened portion 149 is defined within the fourth panel 140 by line of weakening 145. The weakened portion 149 extends substantially from edge 141 to edge 143 of the fifth panel 140. In some embodiments the weakened portion 149 may extend all the way to the edges 141 and 143 and in other embodiments, the weakened portion may even extend beyond the edges 141 and/or 143 and onto the ninth flap 142 and/or the tenth flap 144. In the illustrated embodiment, the line of weakening 145 that defines the weakened portion 149 extends through the substantially circular shaped cut-out 148; however, in other embodiments the line of weakening 145 may simply pass in close proximity to the cut-out 148, either on the side proximate to the edge 111 or the side distal to the edge 111. The general shape of the second weakened portion can vary, as described with relationship to the first weakened portion 139, however, the overall shape of the second weakened portion 149 should be a substantially the same as the first weakened portion 139.

In the illustrated embodiment, the distances d1-d4 on the fifth panel 140 is larger than the distances the distances d1-d4 on the fourth panel 130 but, in some embodiments these values could be identical.

It should be appreciated that aspects of the present invention can also be incorporated into structures that have more than 5 panels or less than 5 panels. For instance, a four panel configuration would include the equivalent of panels 101, 110, 120 and 130 and then simply provide a flap rather than a panel 140. Alternatively, the structure could consist of three full panels, similar to panels 101, 110 and 120, and then two half panels, or two-thirds sized panels that can overlap to complete the structure.

Folded Perspective View

Figure 2:
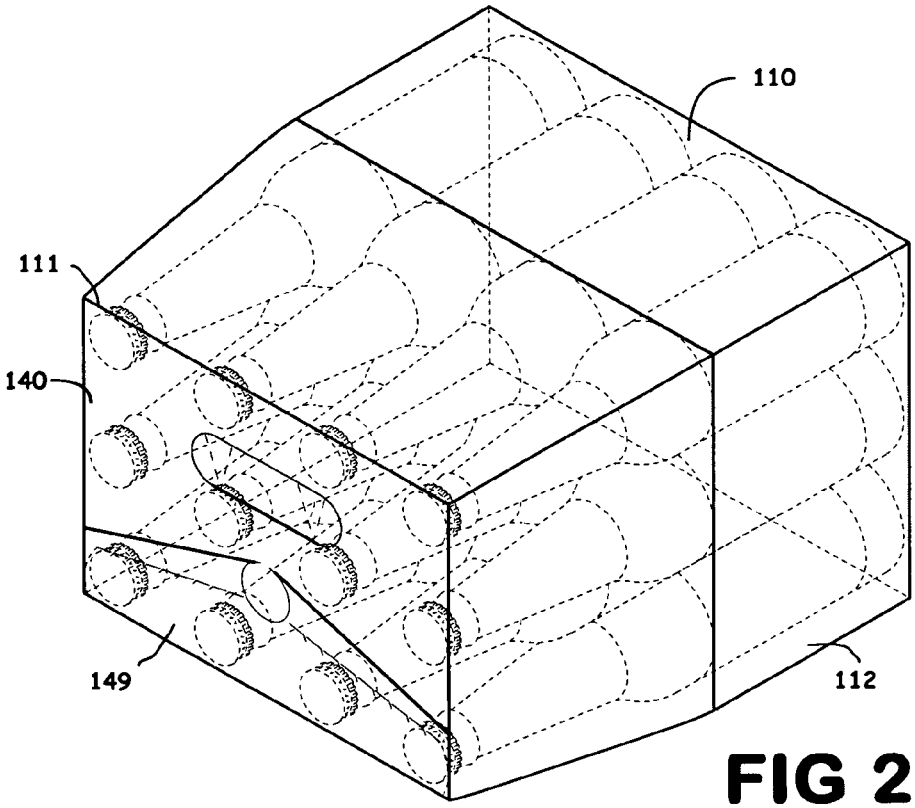
FIG. 2 is a perspective view of a folded version of the embodiment of the invention illustrated in FIG. 1 housing contents.

FIG. 2 is a perspective view of a folded version of the embodiment of the invention illustrated in FIG. 1 housing contents. The folding of the cut-out structure is typically performed by a machine which assembles, applies adhesive and populates the package. However, to provide clarity to the reader a simple manual procedure for folding the cut-out structure is provided. This procedure is not necessarily the method used in the actual production of the container but is simply provided to illustrate how the various panels are engaged. To create the folded embodiment, the first panel 101 can be placed onto a flat surface and the second panel 110 and fifth panel 140 is raised by folding along edge 104. The third panel 120 and the fourth panel 130 are likewise raised by folding along edge 105. The fourth panel 130 is folded over to a position that is in a substantially parallel plane to the first panel 101 by folding along edge 121. The fifth panel 140 is folded over the fourth panel 130 by folding along edge 111 so that the oblong hold 136 is aligned with the oblong partially cut-out hole 146 and the substantially circular hole 138 is aligned with the substantially circular partially cut-out hole 146 and the first weakened portion 139 is aligned with the second weakened portion 149. The products can then be placed into the cavity formed by the five panels. The side flaps can then be folded inwardly and where any flaps or panels overlap, adhesive can be applied to maintain the packaging in its folded configuration. In operation, flaps associated with the oblong partial cut-out 146 can be folded through the oblong cut-out 136 and the flap associated with the oval partial cut-out 148 can be folded through the oval cut-out 138 creating a handle for carrying the package.

In the illustrated embodiment, the second panel 110 is also shown as including a portion of the second perforation portion 145. In this embodiment, as the line of weakening 145 crosses the edge 111 between the fifth panel 140 and the second panel 110, the line of weakening 145 arcs or tapers away from the corner formed by the junction of edge 111 and edge 113 and in the general direction of edge 104 and edge 115 to a point that is a distance d5 from the edge 113 and a distance d6 from the edge 111. At this point, the line of weakening 145 continues towards side 115 on a path that is substantially parallel to edge 111 and extending to a point that is a distance d7 from the edge 115 and a distance d8 from the edge 111. At this point, the line of weakening 145 tapers or arcs substantially towards the corner defined by the junction of edge 111 and edge 115. Advantageously, as best seen in FIG. 2, the removal of the first weakened portion 139 and the second weakened portion 149 will result in providing access to the interior of the folded packaging in such a manner that the contents along the side of the second panel 110 are visible and accessible to the consumer. It should be appreciated that the second weakened portion 149 can be entirely contained within the fifth panel 140 or can include a portion, as illustrated, that extends onto the second panel 110.

Advantageously, the illustrated embodiment of the present invention can be used for packaging, among other products, bottled beverages. The alignment of the oblong cut-out 136 and the oblong partial cut-out 146, as well as the substantially circular cut-out 138 and the substantially circular partial cut-out 148 serve as a handle for carrying the loaded packaging. The bottled beverages can be placed into the packaging in an upright position as is common in the industry. However, when the package is opened by removing the first weakened portion 139 and the second weakened portion 149, which typically can be adhered to each other, the packaging can be laid on it side such that the second panel 110 resides on the shelf surface with the fifth panel 140 facing towards the front of the shelf. The consumer will then have access to the bottled beverages through the opening created by the removal of the weakened portions. The structure illustrated in FIGS. 2 and 3 advantageously exposes an entire row of bottles. As bottles are removed, the position vacated is then filled with another bottle, if any, that is stacked on top of the first row of bottles.

Figure 3:
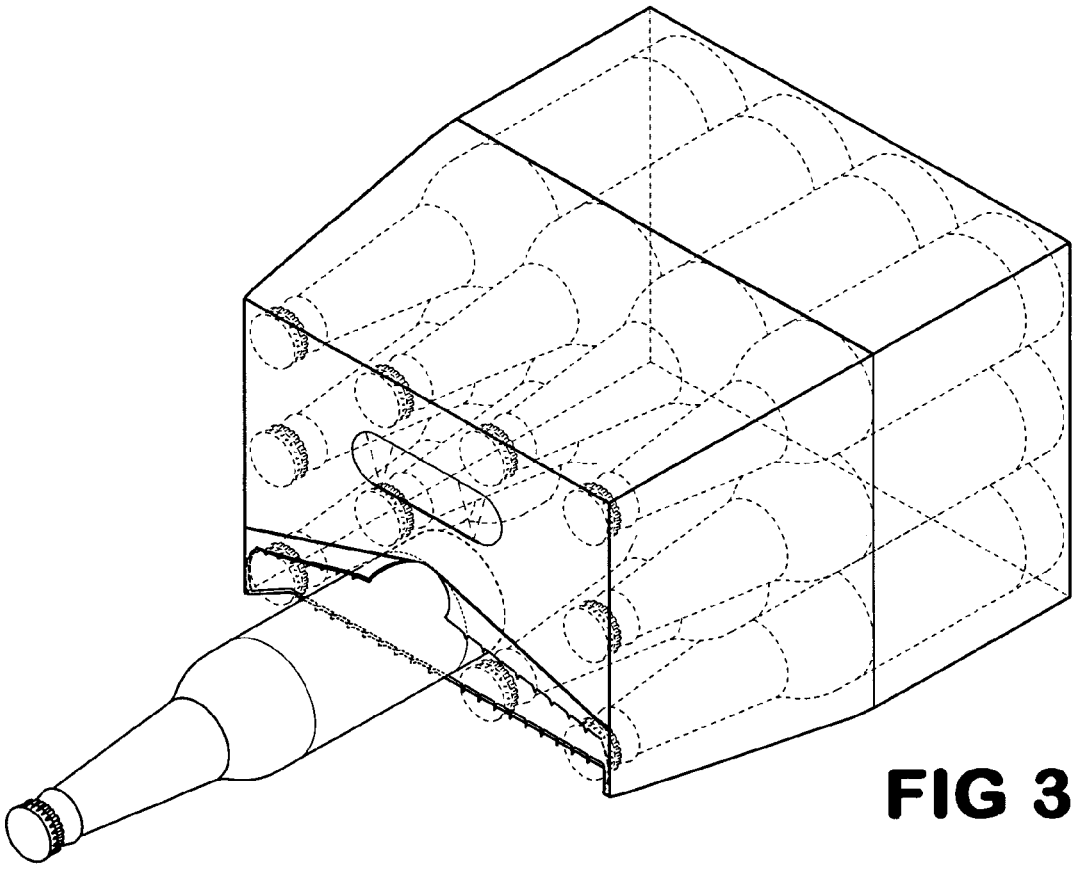
FIG. 3 is a perspective view of a folded version of the embodiment of the invention illustrated in FIG. 1 housing contents with a weakened panel removed to grant access to the contents.

FIG. 3 is a perspective view of a folded version of the embodiment of the invention illustrated in FIG. 1 housing contents with a weakened panel removed to grant access to the contents.

Figure 4:
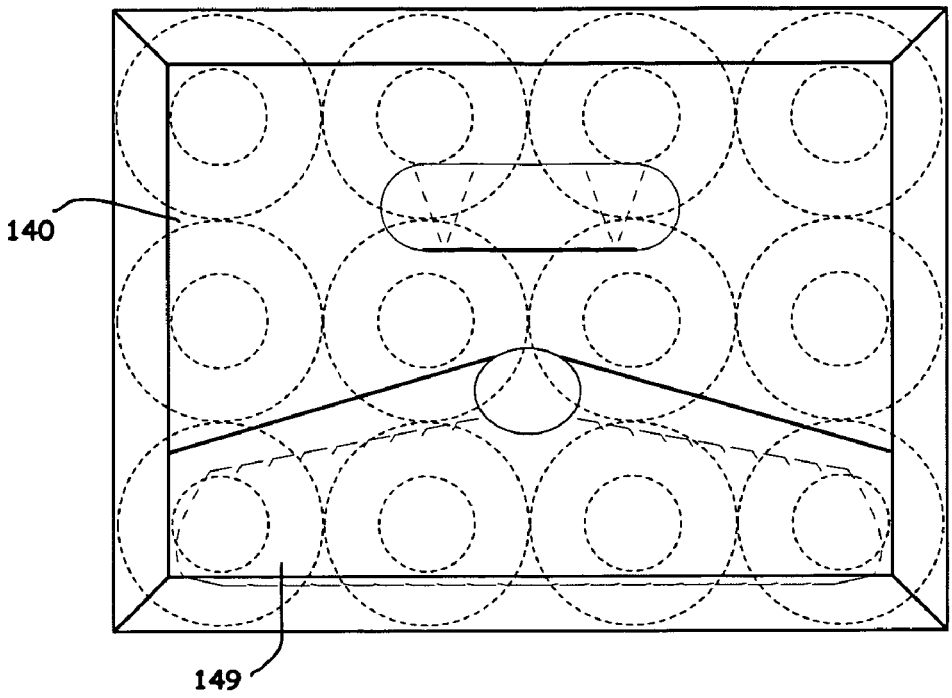
FIG. 4 is a frontal view of the embodiment of the present invention illustrated in FIG. 1 with the illustrated panel including the weakened portion.

FIG. 4 is a frontal view of the embodiment of the present invention illustrated in FIG. 1 with the illustrated panel including the weakened portion.

Figure 5:
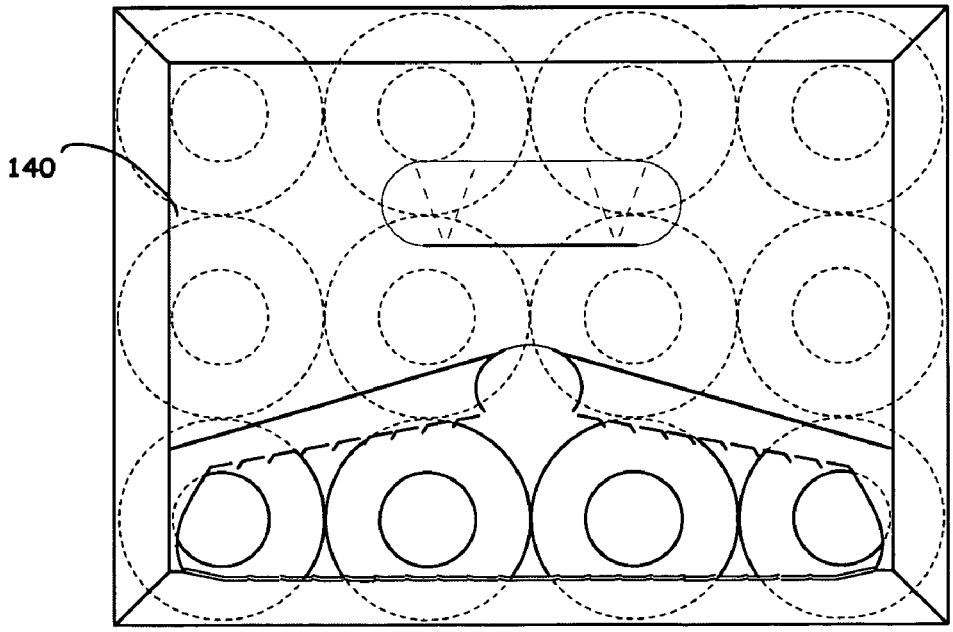
FIG. 5 is a frontal view of the embodiment of the present invention illustrated in FIG. 1 with the illustrated panel with the weakened portion having been removed.

FIG. 5 is a frontal view of the embodiment of the present invention illustrated in FIG. 1 with the illustrated panel with the weakened portion having been removed.

Flat Panel Cut-Out—Side Oriented

Figure 6:
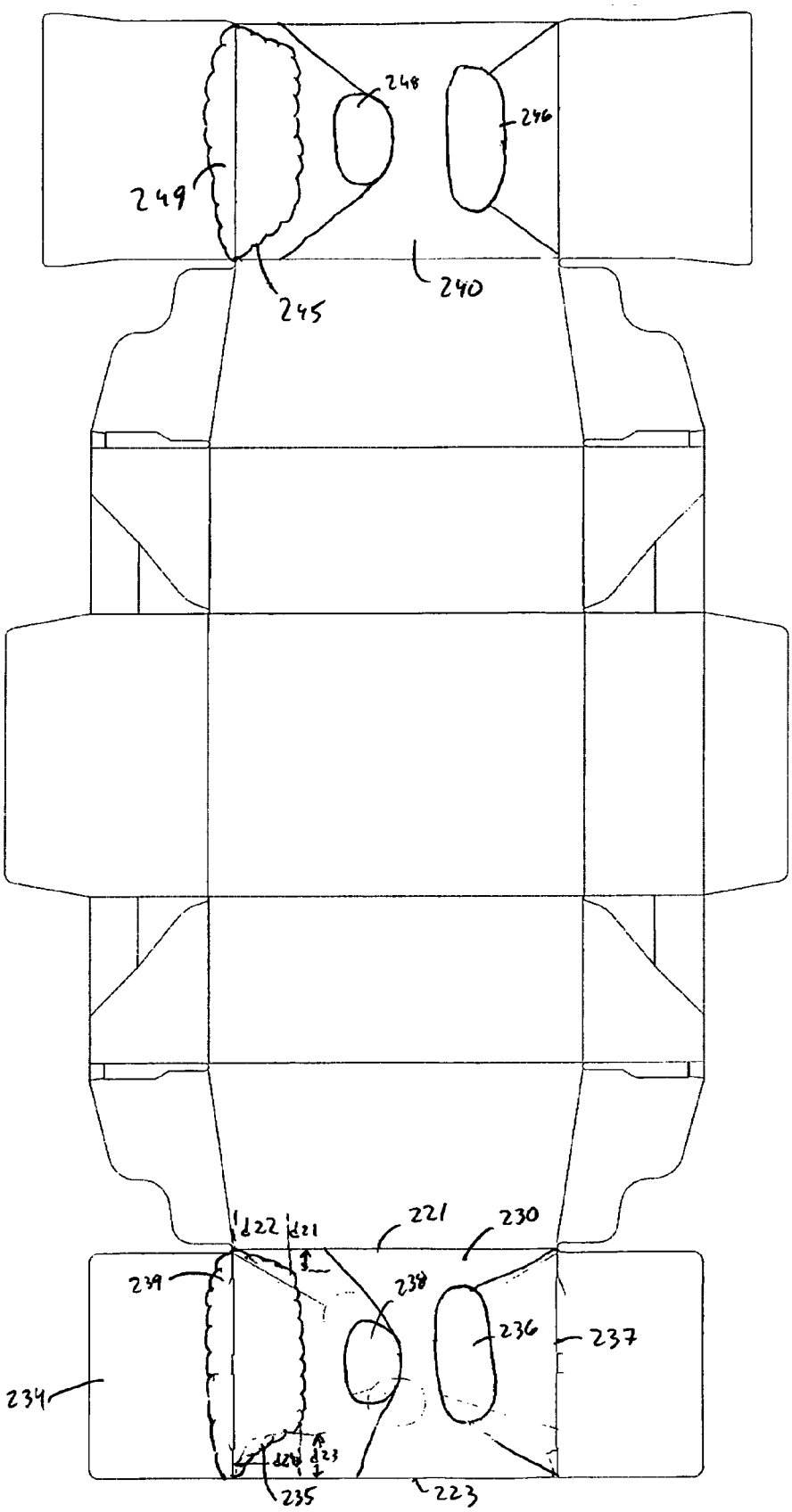
FIG. 6 is a flatly spread out plan view of a cut out structure for an alternate embodiment of the present invention.

FIG. 6 is a flatly spread out plan view of a cut out structure for an alternate embodiment of the present invention. The illustrated embodiment demonstrates how aspects of the present invention can be employed in a package that has a different orientation than the package illustrated in FIG. 1. In this embodiment, the fourth panel and the fifth panel are the only panels that require modification in view of FIG. 1 and thus, they will be the only panels described. The fourth panel 230 includes an oblong cut-out 236 that is located proximate to the edge 233 with the longest side being substantially parallel to the edge 233. An oval or substantially circular cut-out is positioned distal to the edge 233 in a direction towards the edge 231.

A first weakened portion 239 is defined by a line of weakening 235. The line of weakening 235 begins near the corner defined by the edge 221 and 231. The line of weakening 235 extends towards edge 233 with a slight taper or arc away from edge 221 for a distance d21 from the edge 221 and d22 from the edge 231. It should be appreciated that in other embodiments that utilize aspects of the present invention, the line of weakening could also be parallel to the edge 221, curvilinear or oblique angled line. The line of weakening 235 then extends away from the edge 221 at an angle in relationship to edge 231 that can range from negative 10 degrees (towards edge 231) to zero degrees (parallel to edge 231) to approximately a 40 degree angle away from edge 231. At a point approximately equidistance between the edge 221 and the edge 223, the line of weakening 235 then angles towards the edge 231 at an angle in relationship to edge 231 that can range from negative 10 degrees (toward edge 233) to zero degrees (parallel to edge 231) to approximately a 40 degree angle towards the edge 231. At a point that is a distance d23 from the edge 223 and a distance of d24 from the edge 231, the line of weakening 235 then tapers or arcs substantially toward a corner defined by the edge 223 and the edge 231. It should be appreciated that the illustrated path for line of weakening 235 is simply one embodiment of this aspect of the invention and other embodiments are also anticipated. For example, the line of weakening can coincide with the edge 221 for a particular distance away from edge 231, then take a substantially 90 degree turn and extend across the panel 230 substantially parallel to the edge 231 and extend to edge 223. Then the line of weakening 235 can coincide with the edge 231 and extend towards the edge 231. Finally, the line of weakening 235 can extend from edge 223 to edge 221 along the edge 231 to create a substantially rectangularly shaped first weakened portion. Alternatively, the line of weakening 235 may consist of an arc that extends from a point at or near the corner defined by the joint of edge 221 with edge 231 and to a point at or near the corner defined by the joint of edge 223 with edge 231 and then extend from these two points in a substantially linear manner parallel or coincidental to edge 231. It will also be appreciated that the first weakened portion 239 can be entirely contained on the fourth panel 230 or it may also extend onto the flap 234.

In the embodiment described, the distances d21, d22, d23 and d24 can vary but in the illustrated embodiment, the distances d21 and d23 range from 0.25 of an inch to 1.25 of an inch and the distances d22 and d24 range from 0.5 inches to 3.5 inches. Various other configurations and distances may also be used without departing from the spirit and scope of this aspect of the invention.

The fifth panel 240, similar to the fifth panel 140 described in connection with FIG. 1, includes corresponding elements. The oblong partial cut-out 246, the oval partial cut-out 248 and the second perforated section 249 defined by line of weakening 245 are similar in size and placement to the counter parts described for the fourth panel 230 and include the same attributes as describe for the fifth panel 140 of FIG. 1.

Figure 7:
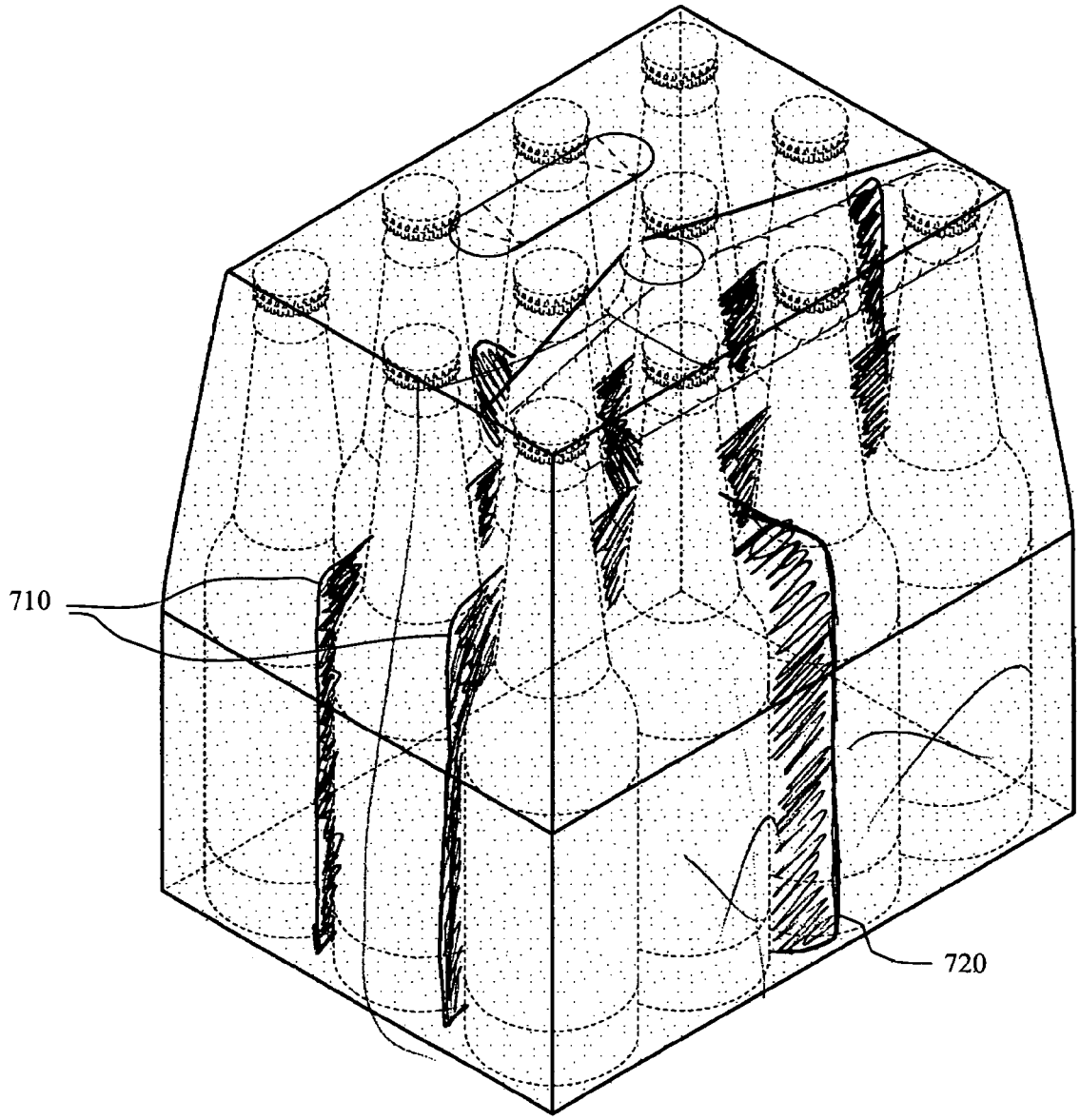
FIG. 7 is a perspective view of a folded version of the embodiment of the invention illustrated in FIG. 1 and including dividers.

FIG. 7 is a perspective view of a folded version of the embodiment of the invention illustrated in FIG. 1 and including dividers. Those familiar in the art will be aware of the use of internal dividers 710 that are place in the interior of bottled beverage packaging to protect the glass bottles during shipment or carrying. Advantageously such a structure can still be utilized in conjunction with various embodiments of the present invention. As bottles are removed from the opening of the packaging, the divider structure collapses due to the weight of bottles that are stacked on top. As the divider structure collapse, the bottles in the upper rows of the bottles descend into the opening area and the dividers rest on the side of the second panel 110. The dividers can simply be a flat panel that runs parallel to plane of the second panel 110 and the third panel 120. In addition, the dividers may include a flap 720 that extends in a somewhat perpendicular plane to the second panel 110 and the third panel 120. In both cases, as the bottles are removed from the packaging, the dividers collapse and come to rest on the surface of the second panel 110.

Figure 8:
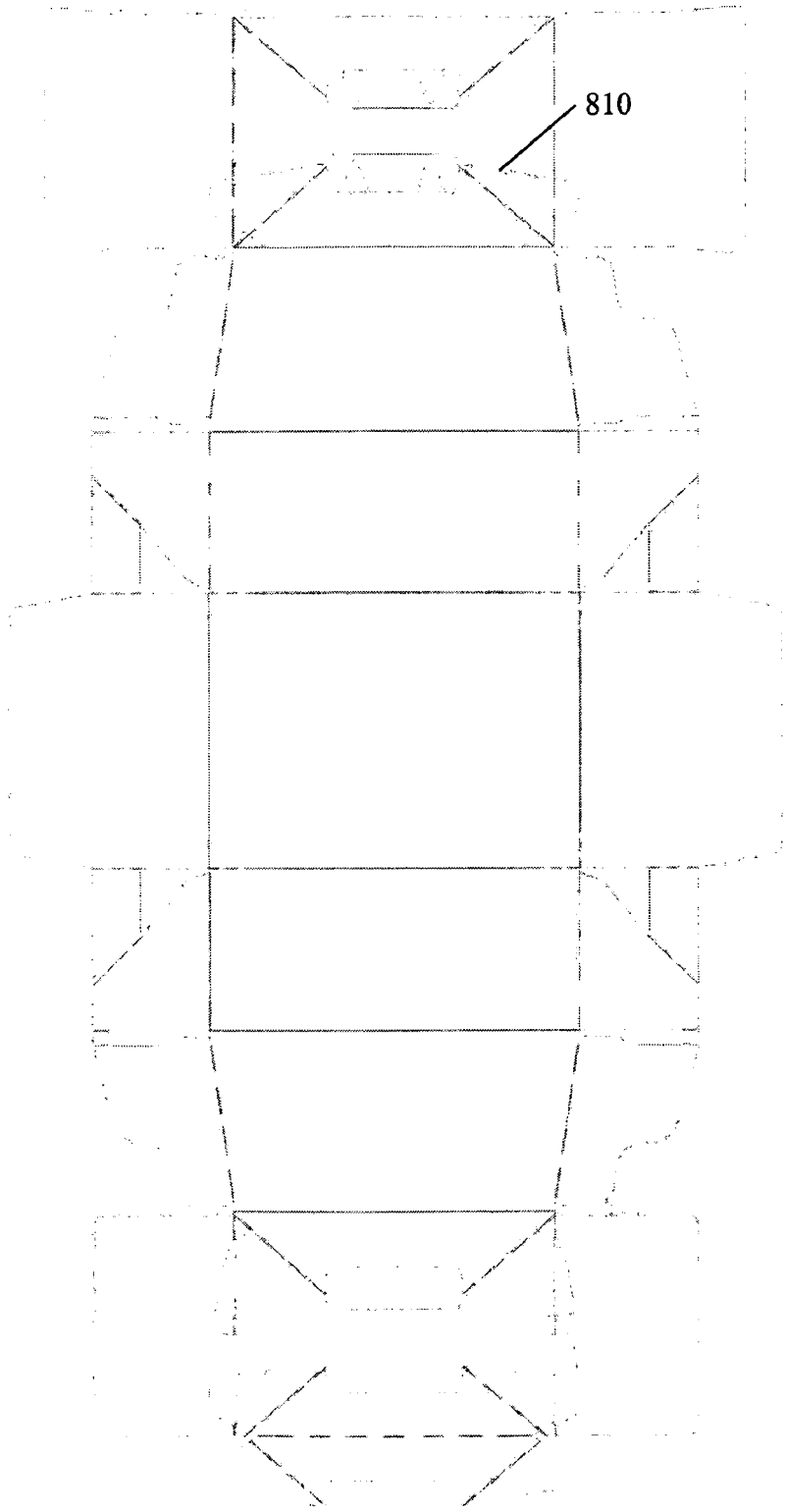
FIG. 8 is a flatly spread out plan view of a cut out structure for yet an alternate embodiment of the present invention.

FIG. 8 is a flatly spread out plan view of a cut out structure for an yet another alternate embodiment of the present invention. In this embodiment of the invention, two additional aspects of the present invention are apparent. The first aspect is a modified weakened portion 810. This modified weakened portion 810 is structured in such a manner as to reduce the risk of tearing or severing the weakened portion when removing it from the package. In addition, a support structure can also be incorporated into an embodiment of the present invention. The support structure is an area on the surface of the flat panel in which structure is added to decrease or discourage that portion of the package from tearing. Thus, by reinforcement of the package, the weakened panel 810 can be readily removed without a fear of inflicting damage to the remainder of the package. The support structure can take on a variety of embodiments such as simply applying an additional layer of the panel material to one or both sides of the weakened line, either on the internal surface or the external surface. In another embodiment, a fibrous material, such as a nylon strip can be attached to one or both sides of the weakened line. Other embodiments may also be employed but the operation of the feature is to provide extra strength along the weakened line so as to encourage the detachment of the weakened portion along the weakened line.

It should be appreciated that aspects of the present invention can advantageously be incorporated into the presently popular 12-pack style bottle beverage carrier. Such a bottled beverage carrier can house objects such as aluminum, glass or PET bottles or cans or other similar shaped objects that require a dispensing type carriers. Aspects of the present invention can be incorporated into such a carrier by placing a die cut opening feature on the top panels. Initially, the thumb hole and hand hold areas of the handle area are pressed inwardly, creating a notched carrying hole for the hand. By the handle being offset to the non-opening side, this allows the consumer's fingers to not interfere with the bottles, bottle crowns, bottle caps or other portions of the products housed within the carrier. After the thumb and hand die cuts are broken and the consumer has purchased and carried the package home, the opening feature (the perforated area), is removed along the lines of perforation or other similar weakening lines cut into the package. Thus, an opening to access the contents on the interior of the package carrier is created. The container can then be place in a refrigerator or on a shelf resting on its side panel with the opening being position at the bottom of the package. This forms a dispensing area for the contents. As each item is removed from the carrier, the other items fall into the dispensing area. In the case where internal dividers are used, such as is typical for glass bottled beverage containers, the dividers provide vertical protection of glass to glass contact as well as providing support for the next subsequent layer of items which are ready to be lowered down into the dispensing area. As with glass bottles being dispense, the horizontal divider or inserts protect the bottles not only during transportation but also in the dispensing mode. As each layer of the product is removed the inserts collapse down to the bottom level in which to allow the next subsequent layer of the product to be dispensed via the opening.

Aspects of the present invention can also be incorporated into in-store dispensing packaging. Advantageously, such an embodiment of the present invention allows the products to be dispensed within a retail center using the same packaging that the product was originally shipped. The novel dispensing mechanism of the present invention not only provides an improved method for dispensing the product, but also allows the advertisement and marketing design elements of the packaging to operate to attract consumers not only while the package is on the shelf, but also while it is being dispensed.

It should be appreciated that aspects of the present invention can be incorporated into yet other embodiments. For instance, the perforated removable section can be located on the bottom of the assembled packaging. Once the package is laid on its side, the perforated section can be removed thereby providing access to the contents of the package. The perforated opening can also be located entirely on the side of the package. In this embodiment, the perforated opening can extend the entire height of the package and be of sufficient width to allow a single product to be easily gripped and removed from the packaging. In this and other embodiments, mechanisms can be included within the package to encourage the product within the package towards the opening. Such an aspect of the present invention would further ease the dispensing of the products. Such mechanisms may include spring loaded panels, elastically drawn panels or panels that are positioned in a manner to encourage the product towards the opening.

Aspects of the present invention have been described in general and in specifics with reference to various embodiments. It should be appreciated that some or all of the aspects of the present invention can be incorporated into the various embodiments described as well as other embodiments not shown. The examples provided in the description are for illustrative purposes only and are not intended to limit the scope of the various aspects of the invention.

What is claimed is:

1. A product package constructed of foldable flat material comprising:

a first panel;

a second panel;

a third panel;

a fourth panel; and at least a portion of a fifth panel, the first panel being substantially rectangular in shape and including a first flap and a second flap;

the second panel being substantially rectangular in shape and including a third flap and a fourth flap;

the third panel being substantially rectangular in shape and including a fifth flap and a sixth flap;

the fourth panel being substantially rectangular in shape and including a seventh flap, an eight flap, a first opening and a second opening;

the first panel being connected on a first side to the second panel and on an opposing side with the third panel;

the second panel being connected to the fourth panel on a side opposing the connection between the first panel and the second panel;

the third panel being connected to the at least a portion of the fifth panel on a side opposing the connection between the third panel and the first panel; and a first weakened portion that is partially defined within the at least a portion of the fifth panel and partially defined within the third panel, and the first weakened portion being closely proximate to a first opening flap defined within the at least a portion of the fifth panel and the weakened portion extends substantially the entire width of the at least a portion of the fifth panel proximate to the location where the fifth panel is connected to the third panel and such width is equal to or greater than the length of the at least a portion of the fifth panel.

2. The product package of claim 1, wherein the at least a portion of the fifth panel being substantially rectangular in shape and including a ninth flap, a tenth flap, the first opening flap coinciding with the size of the first opening of the fourth panel and a second opening flap that coincides with the size of the second opening of the fourth panel.

3. The product package of claim 2, wherein when folded, the fourth panel and the at least a portion of the fifth panel overlap and the first opening and second opening of the fourth panel are aligned with the first opening flap and the second opening flap of the at least a portion of the fifth panel.

4. The product package of claim 3, wherein the fourth panel includes a second weakened portion that coincides with the portion of the first weakened portion that is partially defined within the at least a portion of the fifth panel and, when folded, the second weakened portion is in alignment with the portion of the first weakened portion that is partially defined within the at least a portion of the fifth panel.

* * * * *